United States Patent [19]

Finlay

[11] 4,310,929

[45] Jan. 19, 1982

[54] REVERSIBLE RUNNING SHORTS

[76] Inventor: Susan L. Finlay, 107 Taylor Dr., Fairfax, Calif. 94930

[21] Appl. No.: 145,518

[22] Filed: May 1, 1980

[51] Int. Cl.[3] ..... A41D 1/08

[52] U.S. Cl. ..... 2/238; 2/DIG. 2

[58] Field of Search ..... 2/238, 406, 403, 402, 2/DIG. 2

[56] References Cited

U.S. PATENT DOCUMENTS

| | | | |
|---|---|---|---|
| 1,329,119 | 1/1920 | George | 2/238 X |
| 2,591,079 | 4/1952 | Leaton | 2/402 X |
| 3,317,923 | 5/1967 | Levi | 2/DIG. 2 |

*Primary Examiner*—H. Hampton Hunter

*Attorney, Agent, or Firm*—Townsend and Townsend

[57] ABSTRACT

Disclosed is a pair of reversible, wrap-around shorts particularly suited for use by runners or joggers. The shorts have two panels sewn together so that the outer surfaces of the panels are finished surfaces. The outer edges of the panels are folded over toward the opposed panel and are sewn so that the edges of the panels are both disposed inwardly and are captured between the panels thus producing a finished appearance to both sides of the garment. When spread out on a flat surface, the shorts have an hourglass shape. The upper and lower edges comprise the waistband while the narrow inner portion comprises the crotch. Each panel comprises at least two sections. In the preferred embodiment, the panels are produced by sewing together the respective U-shaped inner edges of a pair of horseshoe-shaped sections. The resulting hourglass-shaped panel has a contoured fit when worn. The waistband is typically provided with an adjustable, quick release fastener. This allows a wide degree of adjustability to suit the individual's particular anatomy and snugness of fit. Also provided is a reversible liner which is sewn at the waistband and captured between the abutting panels.

14 Claims, 5 Drawing Figures

REVERSIBLE RUNNING SHORTS

This invention relates to wraparound reversible shorts, particularly of a type suited for runners or joggers.

BACKGROUND OF THE INVENTION

Reversible clothing is designed and constructed to be worn with either side facing out. To be reversible, the clothing should provide a finished appearance no matter which way it is worn. The main advantage of reversible clothing, such as reversible vests, is that the two sides can be made of different color or patterned material. Thus, a single garment expands the owner's wardrobe at almost half the cost.

Reversible shorts are known, although they are not common. In particular, U.S. Pat. Nos. 2,142,922 and 3,317,923 disclose reversible shorts. Most shorts, like other garments, are made to be worn loosely, such as the straight-leg boxer type shorts, or have darts to provide a more contoured fit. It is often desired that the garment fit snugly about the body and yet not restrict the wearer's freedom of movement. For example, runners often prefer shorts which are not baggy, to reduce the chafing effect which such garments may produce, but which are also loose enough as to not hinder their running movements. However, the prior art fails to disclose shorts which are both reversible and suitable for use by persons engaging in athletic activities such as running or jogging.

Other patents which may be of interest are U.S. Pat. Nos. 2,431,571; 3,317,923; and 4,051,854.

SUMMARY OF THE INVENTION

The present invention solves the problems of the prior art by providing a pair of running shorts which is reversible and form-fitting and yet is readily adjustable to fit persons of various sizes. The shorts only minimally restrict the movement of the user, are relatively simple to make and are expensive to produce.

The reversible, wrap-around shorts of the present invention have two panels sewn together so that both sides, i.e. the outer and inner sides, are finished in appearance. The sides may be made of different material and so may be coordinated with the rest of the user's attire. The shorts are constructed so that the outer edges of the opposed panels are both disposed inwardly toward one another and are captured between the interior sides of the panels, such as by sewing, thus producing a finished appearance regardless which side is worn on the outside.

When the garment is spread out on a flat surface, the shorts have an hourglass shape. The upper and lower generally straight edges comprise the waistband segments while the narrow inner portion comprises the crotch. Each panel includes at least two sections, each section having a horseshoe shape. In the preferred embodiment, the panels are produced by sewing together the respective U-shaped inner edges of a pair of the horseshoe-shaped sections. The resulting hourglass-shaped panel has a proper contoured fit in the crotch area without the need for darts.

The horseshoe-shaped sections further provide a wrap-around adjustable garment which both fits the contours of the body and allows freedom of movement while being worn. The generally elastic waistband is typically provided with a quick release fastener, such as that manufactured under the trademark "Velcro." This allows a wide degree of adjustability to suit the individual's particular anatomy. Also provided is a reversible liner which is sewn between the upper and lower edges of the abutting panels.

A primary object of the present invention is to provide a pair of shorts which are reversible. This object is accomplished by sewing or binding two panels, each panel being made from at least two sections, the edges of the panels are folded inwardly so that when sewn together the panels produce a finished appearance when viewed from either side.

The shorts of the present invention are adaptable to fit people of varying sizes. This is accomplished through the use of an hourglass-shaped, wrap-around design in conjunction with adjustable waist fasteners, such as "Velcro" tabs. Because fewer sizes are needed, the manufacturer can produce the shorts at a lower cost thus resulting in a saving to the consumer. Further, the wrap-around configuration allows the wearer a great deal of individuality in how the garment is worn.

A further object of the present invention is to provide a pair of generally form-fitting running shorts which can be produced from a minimal number of cloth panels and which does not require darts in its construction. Because each panel can be made from as few as two sections, each section requiring only one pattern piece, a garment which generally follows the contour of the user's body can be produced at a lower cost. The absence of darts and the reduction in the number of sections required by the instant invention further adds to the ability to match segments of a patterned material.

Additional objects, features and advantages of the present invention will appear from the following description in which the preferred embodiment has been set forth in detail in conjunction with the accompanying drawings.

DETAILED DESCRIPTION OF THE PREFERRED EMBODIMENT

As shown in the Figures, shorts 2 are made from two panels 4, 6 which are typically sewn together along their inwardly folded outer edges, thereby producing a garment which has a finished appearance viewed from either side and is therefore reversible. Each panel is made from at least two sections. A typical pattern 18 for such sections is illustrated in FIG. 2.

For clarity, the sections will be discussed first. The way in which the sections are sewn together to produce a panel will then be addressed. Finally the combination of panels 4 and 6 will be described.

Figure 1:
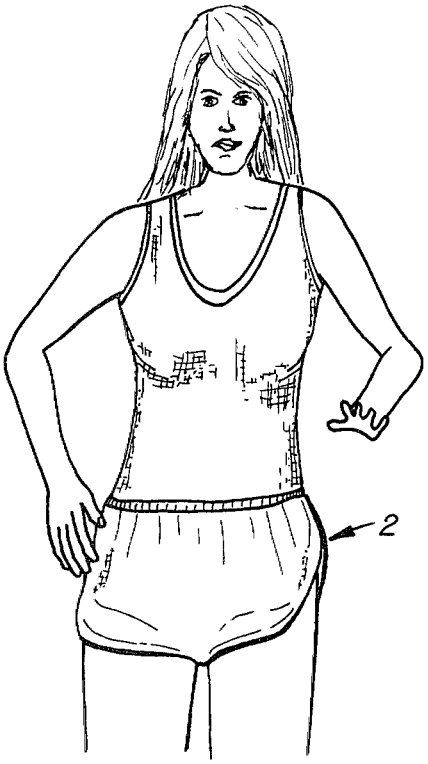
FIG. 1 shows the shorts of the present invention being worn by a jogger.
Figure 2:
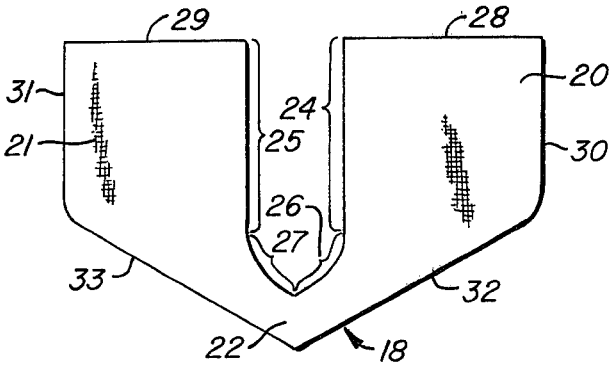
FIG. 2 is a plan view of a pattern for a section of the shorts of the present invention.

Individual sections 10, 12, 14 and 16 all have the shape depicited by pattern 18 in FIG. 2. Pattern 18 is generally horseshoe-shaped having widened extensions 20, 21 and a relatively narrow connecting portion or strap 22. The interior edges 24, 25 define a slot between extensions 20, 21, the slot completed by the generally arcuate interior edge portions 26, 27. The upper edges 28, 29 which terminate extensions 20, 21, are straight and generally normal to inner edges 24, 25. The outer edges 30, 31 of the extensions are also generally normal to their respective upper edges 28, 29 and extend between upper edges 28 and respective outer edges 32, 33 of connecting portion 22. Edges 32, 33 are generally straight and extend at an angle from the lower ends of edges 30, 31 where they intersect centrally below interior edge portions 26, 27.

Figure 3:
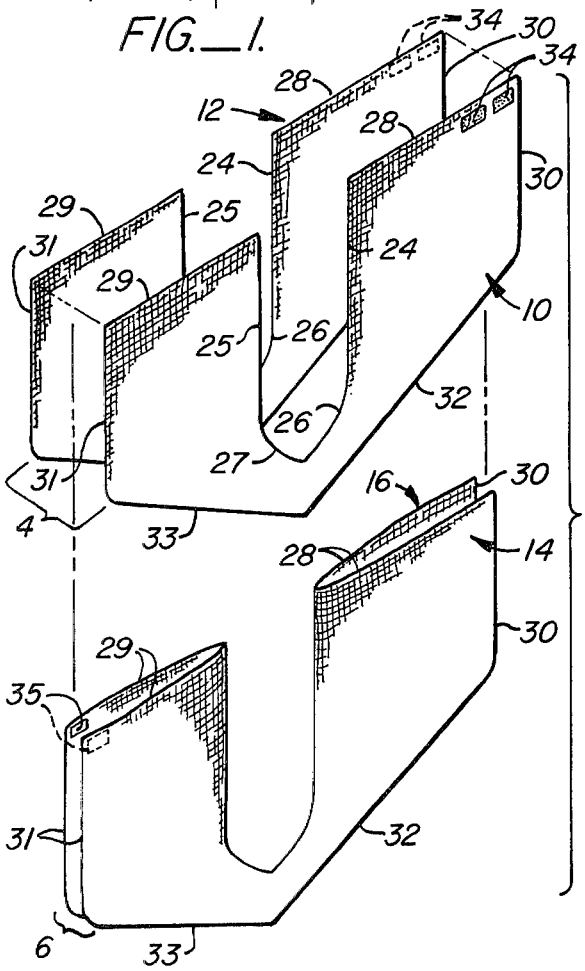
FIG. 3 is an exploded isometric view showing the relationship of four sections prior to being sewn into a single garment.
Figure 4:
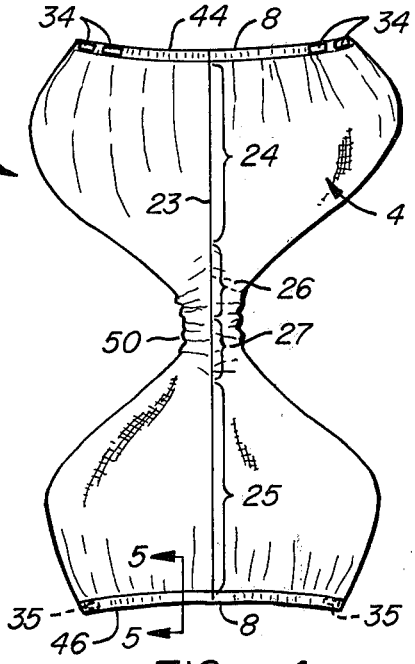
FIG. 4 is a plan view of the assembled garment shown laid out on a flat surface.

The hourglass-shaped panel 4 shown in FIG. 4 is produced from two sections 10, 12, cut according to pattern 18. Sections 10, 12, after being cut from a suitable length of material, are arranged as shown in FIG. 3 so that their interior surfaces are opposed. Section 10 is a mirror image of section 12. The reason for this will become apparent in light of the discussion which follows.

In the manufacture of clothing, it is well known that fabrics often have a finished side and an unfinished side. This is especially true if the material is a print. Because extension 20 of the pattern shown in FIG. 2 is usually not the same size as extension 21, if sections 10 and 12 were not mirror images, when the interior or unfinished surfaces of the cloth are opposed as in FIG. 3, the edges of the sections would not be aligned. Of course, if both sides of the material from which the panel sections are cut are the same, that is both sides finished, the panel sections can all be cut in the same manner. In either case, the mirror image property will not be lost.

Figure 5:
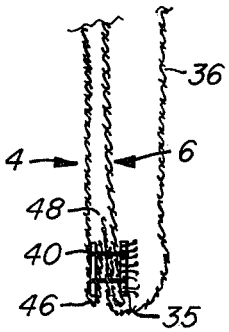
FIG. 5 is a partial cross-sectional view of the waistband portion showing the liner attachment.

Panels 4 and 6 are formed from sections 10 and 12 and sections 14 and 16, respectively, by sewing or otherwise binding the respective interior edges 24, 25 and the respective interior edge portions 26, 27 of the panels. To ensure that a finished appearance is produced, edges 24–27 are folded inwardly towards the opposed panel section prior to being sewn. FIG. 5 discloses such a seam.

After sections 10, 12 are bound along their inner edges thus producing panel 4, panel 6, having been previously constructed in a like manner, is inserted between the opposed sections 10, 12 of panel 4 as shown in FIG. 3. The opposed surfaces of panels 4 and 6 are the unfinished sides of the fabric. Corresponding edges 28 through 33 of sections 10 and 14 and of sections 12 and 16, after being aligned, are bound, typically by sewing. Again, to produce a finished appearance, the opposed respective edges are turned inwardly prior to being sewn so that a finished appearance is produced. Prior to sewing the respective upper edges 28, 29, an elastic band 40 is inserted between such opposed upper edges so that when the edges are sewn together, the band is also sewn between the layers of fabric. The band is sewn while in a stretched or tensive state so that waistband 8 is elastic and adjustable.

"Velcro" tabs are attached to waistband. "Velcro" pile segments 34 and "Velcro" hook segments 35 are attached along the waistband as by sewing. As shown in FIG. 4, a pair of spaced pile segments 34 are attached to panel 4 at both ends of waistband portion 44 and a hook segment 35 is attached to panel 6 at both ends of waistband portion 46. The use of two pile segments at each end of waistband portion 44 provides adjustability of fit. If desired, a greater number of cloth segments 34 or of hooks 35 can be used. Other attaching means, for example a button with a plurality of button holes, can also be used.

If desired, a liner 36 can be used in conjunction with the shorts. Turning to FIG. 5, an edge 48 of liner 36 is captured between the inwardly folded, opposed upper edges of panels 4, 6, typically by sewing. The liner also has a generally hourglass shape and is sized so that when the shorts are worn, the liner does not generally show.

The shorts, when sewn together and laid out on a generally flat surface, have an hourglass shape. The center line 23 shown in FIG. 4, is the edge of intersection of the bound interior edges 24 through 27.

The shorts are worn with the narrow crotch portion 50 of the garment between the legs and the waistband 8 wrapped around the person's waist and secured by pile segments 34 and hook segments 35. The user places narrow crotch portion 50 between the legs and brings the waistband portions 44, 46 up around the waist and attached hook segments 35 to the appropriate pile segments 34 thereby securing the garment to the body. If a liner 36 is used and covers segments 34 and 35 as in FIG. 5, the user slips the ends of waistband portion 44 between liner 36 and panel 6 so that pile segments 34 engage hook sgments 35. The wrap-around design of the shorts of the present invention allow the wearer a great deal of individuality as to the closeness of the fit of the shorts. The wrap-around feature provides for significant freedom of movement while running or engaging in other physical activity. The horseshoe-shaped pattern allows the shorts to be both form-fitting and yet easy to produce because there is no need for darts in the fabric. If desired the panel sections could be produced from two or more subsections.

Although the best mode contemplated for carrying out the present invention has been herein shown and described, it will be apparent that modification and variations may be made without departing from what is regarded as the subject of the invention.

I claim:

1. A reversible pair of shorts particularly suited for use by runners or joggers comprising:

a first hourglass-shaped cloth panel having at least one finished surface;

a second hourglass-shaped cloth panel having at least one finished surface;

a second hourglass-shaped cloth panel having at least one finished side and of substantially identical size as said first panel;

said first and second panels joined along their corresponding edges with finished surfaces exposed to form an hourglass shaped wrap-aroundd garment;

each said first and second cloth panels further comprising first and second generally horseshoe-shaped sections, said sections having opposed wide extensions and a narrow connecting segment, said extensions and connecting segment defining an elongate U-shaped internal edge within each section, said first section being a generally mirror image of said section, said first and second sections being bound along their corresponding U-shaped internal edges, whereby the bound sections form the generally hourglass-shaped cloth panel when laid out on a flat surface; and means for detachably fastening the top and bottom edges of said hourglass-shaped garment so that a wearer can wear said garment with the narrow central portion within the wearer's crotch and the top and bottom edges encircling and fastened around the wearer's waist.

2. The shorts of claim 1 further comprising means for producing an elastic waistband from said top and bottom edges.

3. The shorts of claim 1 further comprising means for concealing the joined outer edges of said first and second panels.

4. The shorts of claim 1 wherein said first panel and said second panel are different colors.

5. The shorts of claim 1 wherein said first section comprises a plurality of subsections.

6. The shorts of claim 1 further comprising generally hourglass-shaped liner, said liner captured between said joined top and bottom edges of said first and second panels.

7. A method for producing reversible shorts comprising the following steps:

providing first, second, third and fourth horeshoe-shaped cloth sections, said sections having finished exterior surfaces, said sections having a generally U-shaped interior edge, first and second generally straight upper edge segments, and a generally U-shaped outer edge, said first and third section being generally of the same size and shape, said second and fourth sections being generally mirror images of said first and third panels;

binding said first section to said second section and said third section to said fourth section along their respective interior edges so that the finished surfaces of said first and second sections and of said third and fourth sections face outwardly, thereby forming first and second panels, said panels each having a generally hourglass-shape when spread out on a generally flat surface, said panels having generally straight upper and lower edges and a narrow central portion;

sewing said first panel to said second panel along their respective corresponding outer edges so that the finished exterior surfaces are exposed thereby producing a finished appearance on each side of the sewn panel; and attaching fastening means along said upper and lower edges.

8. The method of claim 7 further comprising the step of placing an elastic member along at least a portion of one of the upper or lower edges thereby producing an elastic waistband.

9. The method of claim 7 wherein said fastening means are releasable adjustable fastening means.

10. The method of claim 7 further comprising the step of capturing the top and bottom edges of a generally hourglass-shaped liner between the upper edges and the lower edges of the sewn first and second panels.

11. A method for producing reversible shorts which includes the following steps:

forming a cloth member into first, second, third and fourth horseshoe-shaped sections, having a generally U-shaped interior edge, said first and second straight upper edge segments and a generally U-shaped outer edge;

forming the first and third sections to be of the same general size and shape;

making the second and third sections to be generally mirror images of the first and third sections;

binding the first section to the second section and the third section to the fourth section along their respective inner edges so that the respective exterior surfaces of the first and second sections and the third and fourth sections all face outwardly to form first and second panels, said panels having a generally hourglass-shape when laid out on a generally flat surface, said panels having generally straight top and bottom edges;

securing the first panel to the second panel along their respective outer edges so that the interior surfaces are opposed; and attaching fastening means along the secured top and bottom edges.

12. The method according to claim 11 further comprising the steps of:

capturing between the generally straight top and bottom edges of said panels the complementary edges of an hourglass-shaped liner; and placing an elastic member between said upper edge segments prior to said securing step to produce an elastic waistband.

13. A reversible pair of shorts produced according to the method of claim 8.

14. A reversible pair of shorts produced according to the method of claim 12.

* * * * *